US008166580B2

(12) United States Patent
Slade

(10) Patent No.: US 8,166,580 B2
(45) Date of Patent: May 1, 2012

(54) DISPENSING DEVICE AND VALVE FOR USE THEREWITH

(75) Inventor: Brian Parry Slade, Kent (GB)

(73) Assignee: International Trade Corporation Limited, Hertfordshire (GB)

( * ) Notice: Subject to any disclaimer, the term of this patent is extended or adjusted under 35 U.S.C. 154(b) by 1404 days.

(21) Appl. No.: 10/582,364

(22) PCT Filed: Dec. 7, 2004

(86) PCT No.: PCT/GB2004/005151

§ 371 (c)(1),
(2), (4) Date: Mar. 27, 2007

(87) PCT Pub. No.: WO2005/056941

PCT Pub. Date: Jun. 23, 2005

(65) Prior Publication Data

US 2007/0214554 A1 Sep. 20, 2007

(30) Foreign Application Priority Data

Dec. 11, 2003 (GB) ..... 0328702.6

(51) Int. Cl.
*E03D 9/02* (2006.01)

(52) U.S. Cl. ..... 4/227.1; 4/222; 4/227.3; 4/227.4; 4/227.5; 222/57

(58) Field of Classification Search ..... 4/222, 223, 4/227.1–227.5; 222/57
See application file for complete search history.

(56) References Cited

U.S. PATENT DOCUMENTS

| | | | | |
|---|---|---|---|---|
| 3,254,797 | A | 6/1966 | Porter | |
| 3,339,801 | A | 9/1967 | Hronas | |
| 4,212,089 | A * | 7/1980 | Lindauer | 4/227.4 |
| 4,346,483 | A * | 8/1982 | Rosen et al. | 4/227.3 |
| 4,451,941 | A | 6/1984 | Gray et al. | |
| 6,240,573 | B1 * | 6/2001 | Tsai | 4/227.1 |

FOREIGN PATENT DOCUMENTS

| | | |
|---|---|---|
| DE | 38 36 189 A1 | 4/1990 |
| GB | 03485 A | 0/1913 |
| GB | 946 812 A | 1/1964 |

* cited by examiner

*Primary Examiner* — Steven J Ganey
(74) *Attorney, Agent, or Firm* — Morgan, Lewis & Bockius LLP

(57) ABSTRACT

A dispensing means (10) for delivering a dose of a first liquid into a second liquid is provided, the dispensing means comprising an enclosure (12) for the first liquid, and valve means (16), the dispensing means being operable such that raising a level (114) of a second liquid relative to the dispensing means so as to subject the dispensing means to hydrostatic pressure causes a dose of the first liquid to be displaced from the enclosure (12) to establish a column (118) of the first liquid that acts on the valve means, and subsequent lowering of the level (114) of the second liquid relative to the dispensing means so as to reduce the hydrostatic pressure acting on the valve means (16) causes the valve means to deliver the dose. Also provided is a valve means (16) adapted for attachment to an inlet tube and comprising a valve body (62) and a flexible membrane (72), which, when attached to an inlet tube (22) containing a column of a first liquid and immersed in a second liquid, the hydrostatic pressure causes the flexible membrane (72) to seal the valve body (62) so as to prevent a flow of the first liquid, and when a level of the second liquid is lowered, the flexible membrane (72) unseals the valve body (62) so as to allow a flow of the first liquid through the valve body (62).

13 Claims, 18 Drawing Sheets

DISPENSING DEVICE AND VALVE FOR USE THEREWITH

This application is a Section 371 filing of PCT/GB2004/005151 claiming priority benefit from GB Application No. 0328702.6, filed Dec. 11, 2003.

FIELD OF THE INVENTION

This invention relates to dispensing means for delivering a dose of a first liquid into a second liquid, in particular to dispensing means for delivering a dose of a liquid additive into a lavatory cistern, and to valve means suitable for use with such dispensing means.

BACKGROUND TO THE INVENTION

It is well known to place a block containing soluble substances such as surfactants, disinfectants and fragrances in concentrated form in a lavatory cistern, such that some of the substances dissolve in the water in the cistern between flushes and are dispensed upon flushing into the lavatory bowl.

This method of dispensing the substances into the lavatory bowl has several disadvantages. Firstly, the quantity of the substances that dissolves in the water in the cistern depends on the length of time between flushes, which can vary considerably, and the concentration of the dissolved substances in the water in the cistern can therefore vary considerably from one flush to the next. Secondly, when the lavatory has been flushed, only a small portion of the water from the cistern, and hence only a small portion of the dissolved substances, remains in the bowl, the majority of the dissolved substances therefore being wasted.

International Patent Application No. PCT/US02/15001 (Publication No. WO 02/092924) in the name of S.C. Johnson & Son, Inc. discloses a dispenser for use in a lavatory cistern. The dispenser has an upper reservoir containing a liquid product, a lower dosing chamber containing a floating shuttle, and a first float-operated valve. In use the liquid product trickles down from the reservoir into the dosing chamber. The first float-operated valve is operable to seal the dosing chamber from the lavatory cistern when the cistern is fall of water. The floating shuttle in the dosing chamber forms part of a second float-operated valve that is also operable to seal the dosing chamber from the cistern. When the lavatory is flushed and the water level in the cistern falls below the level of the first float-operated valve, the first float-operated valve opens to allow a dose of the liquid product to flow from the dosing chamber into the remaining water in the cistern. Once the dosing chamber has emptied, the second float-operated valve seals the dosing chamber from the cistern, so as to prevent leakage of the liquid product from the reservoir through the dosing chamber into the cistern until the cistern refills sufficiently for the first float-operated valve to seal the dosing chamber from the cistern.

The dose of the liquid product delivered by the known dispenser is invariant with the length of time between flushes, and is delivered into the cistern just as the cistern empties. It is the water that flows into the lavatory bowl just as the cistern empties that remains in the bowl after flushing. Since the dispenser delivers the dose of the liquid product into this water, most of the liquid product delivered by the dispenser therefore remains in the lavatory bowl after flushing.

On the face of it, the known dispenser therefore appears to have overcome the disadvantages of the known method of dispensing substances into a lavatory bowl.

It is an object of the invention to provide dispensing means that overcomes the disadvantages of the known method of dispensing substances into a lavatory bowl and which is of simpler construction, and hence cheaper to manufacture, than the known dispenser.

While the dispensing means of the invention has been devised to overcome the aforementioned disadvantages of the known method of dispensing substances into a lavatory bowl, it is thought that the dispensing means is suitable for other applications in which it is required to dispense a dose of a first liquid into a second liquid.

SUMMARY OF THE INVENTION

According to a first aspect of the invention there is provided dispensing means for delivering a dose of a first liquid into a second liquid, the dispensing means comprising an enclosure and valve means connected to the enclosure, wherein the dispensing means is operable such that, when the enclosure contains a first liquid, raising a level of a second liquid relative to the dispensing means so as to subject the enclosure and valve means to hydrostatic pressure causes a dose of the first liquid to be displaced from the enclosure to establish a column of the first liquid that acts on the valve means and thereby increase the potential energy of the valve means, and subsequent lowering of the level of the second liquid relative to the dispensing means so as to reduce the hydrostatic pressure acting on the valve means causes the valve means to deliver the dose by release of the potential energy.

The invention therefore provides a dispensing means that is of simpler construction, having only one valve means, than the known dispenser.

The term "liquid" is intended to encompass solutions, suspensions and gels.

Preferably the dispensing means is adapted to dispense a plurality of individual doses in succession, one dose being delivered at each lowering of the level of the second liquid as a container in which the dispensing means is placed is repeatedly filled with, and emptied of, the second liquid.

The dispensing means may therefore advantageously be provided with support means for supporting the dispensing means in a container that is repeatedly filled with, and emptied of, the second liquid, and in preferred embodiments the dispensing means is for placing in a lavatory cistern, the first liquid then being a suitable additive to the water (forming the second liquid) being flushed into the lavatory bowl.

Preferably the support means is a hanger to support the dispensing means from a lip of the container.

The enclosure may advantageously comprise an otherwise substantially rigid vessel that has a flexible portion, which, when subjected to hydrostatic pressure, is deformable so as to displace a dose of a first liquid contained in the vessel from the vessel.

Preferably, however, the enclosure comprises a flexible sachet, which, when subjected to hydrostatic pressure, is deformable so as to displace a dose of a first liquid contained in the sachet from the sachet.

Such a flexible sachet allows for a very compact construction of the dispensing means, which in turn allows the dispensing means to be used in a wide variety of cisterns of different sizes.

The flexible sachet may advantageously be provided with at least one, and preferably two, rigid members adapted to prevent pockets of the first liquid from forming in the sachet as doses of the first liquid are displaced from the sachet.

Preferably the at least one rigid member is formed from a material that has a density greater than that of the second liquid, so as to reduce any tendency for the dispensing means to float in the second liquid.

The dispensing means may advantageously further comprise a vent chamber assembly operable to vent displaced air from the dispensing means as the column of the first liquid is established.

Preferably the vent chamber assembly comprises a vent chamber and first and second tubes, the vent chamber being connected to the enclosure by the first tube and to the valve means by the second tube.

Preferably the dispensing means is operable such that the column of the first liquid is established in the second tube.

Preferably the second tube is provided with capillary means operable to draw the first liquid along the second tube so as to accelerate the establishment of the column of the first liquid.

The capillary means may advantageously comprise a wick, lumenous rod and/or rod with a plurality of fine longitudinal grooves formed on its external surface, the wick or rod being operable to draw the first liquid along the second tube.

Preferably, however, the capillary means comprises a plurality of fine longitudinal grooves formed on the internal surface of the second tube. Such an arrangement has been found to be particularly advantageous because it allows air to be displaced along a central region of the tube as the first liquid is drawn along the internal surface, thus reducing any tendency for airlocks to form in the tube, which might otherwise slow the establishment of the column of the first liquid.

The valve means may advantageously comprise first and second flexible valve members joined so as to form a pocket, and biasing means operable to apply a tensile force to the first and second valve members so as to close the pocket to prevent a flow of the second liquid into the pocket, the valve means being operable such that hydrostatic pressure exerted on the exterior of the valve means by the second liquid tends to prevent a flow of the first liquid from the pocket.

Preferably, however, the valve means comprises a valve body and a flexible membrane, the valve body having inlet and outlet channels between which flow of the first liquid is controlled by the flexible membrane, the valve means being operable such that hydrostatic pressure exerted on the exterior of the valve means by the second liquid tends to cause the flexible membrane to prevent flow of the first liquid between the inlet and outlet channels.

The valve means described above operate by flexure of one or more of their components, as opposed to the sliding movement of the floating valve members of the known dispenser. The valve means of the present invention are believed to be of simpler construction, cheaper to manufacture and less likely to jam than the float-operated valves of the known dispenser.

Moreover, because the valve means of the present invention are operated by hydrostatic pressure, as contrasted with the float-operated valves of the known dispenser, the dispensing means of the invention do not require any adjustment to ensure that the level of the second liquid drops below the valve means. A mere lowering of the level of the second liquid relative to the valve means will suffice, which is not the case with the known dispenser.

According to a second aspect of the invention there is provided valve means for controlling a flow of a first liquid, the valve means being adapted for attachment to an inlet tube and comprising a valve body and a flexible membrane, the valve means being operable such that, when attached to an inlet tube containing a column of a first liquid and immersed in a second liquid so as to subject the valve means to hydrostatic pressure, the hydrostatic pressure causes the flexible membrane to seal the valve body so as to prevent a flow of the first liquid through the valve body, and when a level of the second liquid is lowered relative to the valve means so as to reduce the hydrostatic pressure, the flexible membrane unseals the valve body so as to allow a flow of the first liquid through the valve body.

The invention therefore provides a valve means that is of simpler construction, and more versatile in use, than the float-operated valves of the known dispenser, because the valve means of the invention requires a level of a second liquid in which the valve means is immersed only to be lowered relative to the valve means, rather than lowered to a level below the valve means, as is required by the float-operated valves of the known dispenser.

Preferably the valve body is formed with an inlet channel and an outlet channel, the flexible membrane being operable, when subjected to hydrostatic pressure due to immersion of the valve means in the second liquid, to prevent flow of the first liquid from the inlet channel to the outlet channel.

In a preferred embodiment of the invention, the valve body is so configured that, in use, a first end of the outlet channel through which the first liquid enters the outlet channel is lower than a second end of the outlet channel through which the first liquid exits the outlet channel, such that when the valve means is subjected to hydrostatic pressure, the hydrostatic pressure acting at the first end of the outlet channel is greater than that acting at the second end of the outlet channel.

In this way, when the valve means is immersed in the second liquid, in its intended orientation, the hydrostatic pressure acting to cause the flexible membrane to seal the valve body is always greater than the hydrostatic pressure acting to force the second liquid into the valve body, and the second liquid is therefore prevented from entering the valve body.

BRIEF DESCRIPTION OF THE DRAWINGS

Embodiments of the invention in the form of dispensing means for delivering a dose of a liquid additive into a lavatory cistern, and valve means suitable for use with such dispensing means will now be described, by way of example, with reference to the attached drawing figures, in which.

DETAILED DESCRIPTION OF EMBODIMENTS

Figure 1:
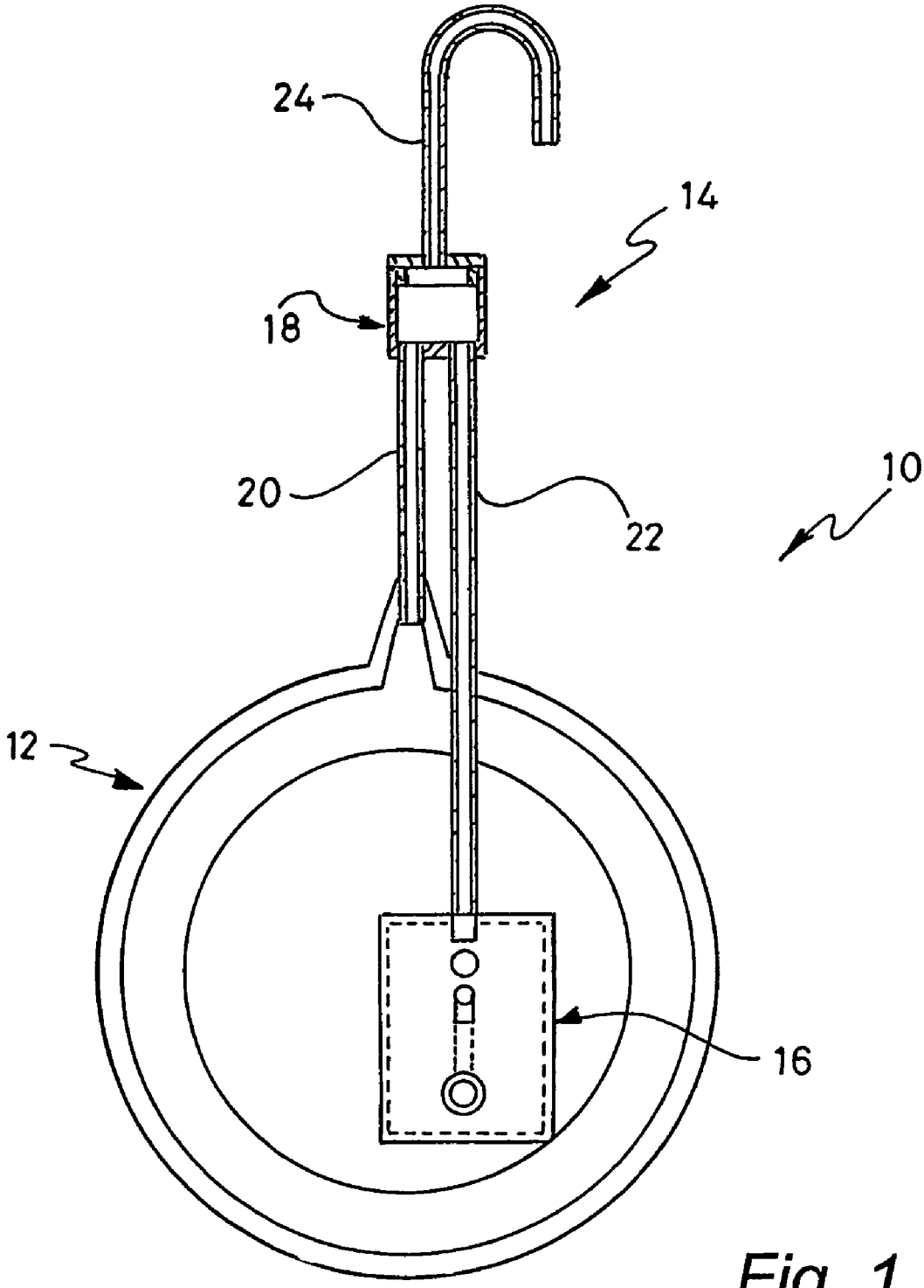
FIG. 1 is a schematic sectional front view of a dispensing means in accordance with the first aspect of the invention.

The dispensing means of FIG. 1 is in the form of a dispenser 10 comprising a polyethylene enclosure indicated generally by reference numeral 12, a polypropylene vent chamber assembly indicated generally by reference numeral 14 and a valve indicated generally by reference numeral 16. The vent chamber assembly 14 consists of a vent chamber 18, which is provided with a liquid inlet tube 20, a liquid outlet tube 22, and a breather tube 24. The liquid inlet tube 20 connects the enclosure 12 to the vent chamber 18 and the liquid outlet tube 22 connects the valve 16 to the vent chamber 18. The breather tube 24 simply vents the vent chamber.

The enclosure is filled with a fragranced surfactant solution (not shown in FIG. 1) but could equally well be filled with one or more of a dye and bleaching or descaling solution. 20 and from the liquid outlet tube 22 during operation of the dispenser. In use, the dispensing means is immersed in the water in a lavatory cistern, oriented as shown in FIG. 1, with the vent chamber assembly 14 above the enclosure 12 and valve means 16.

Figure 2:
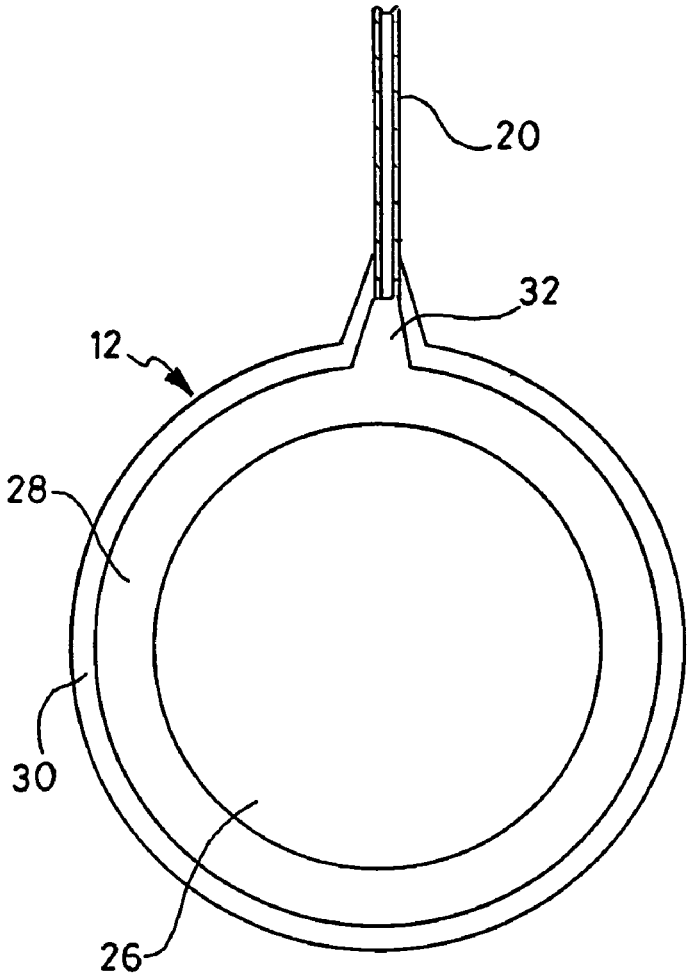
FIGS. 2 and 3 are sectional front and side views, respectively, of the enclosure of the dispensing means of FIG. 1.
Figure 3:
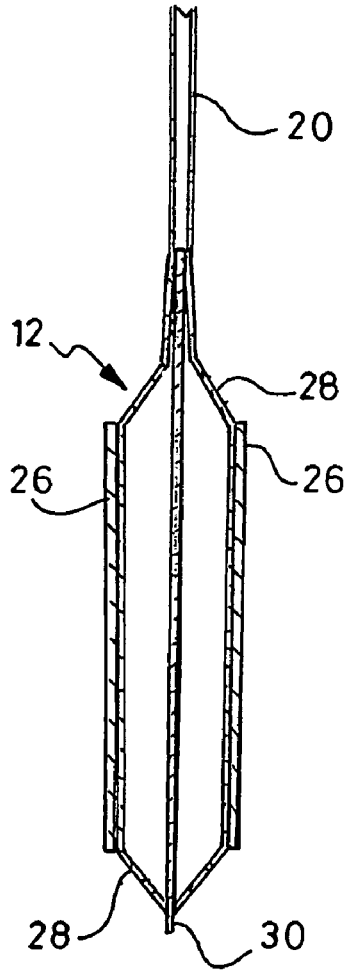

Turning to FIGS. 2 and 3, the enclosure 12 comprises a generally circular polyethylene sachet to either side of which a rigid circular nylon 66 disc 26 is attached. Nylon 66 is used because it has a greater density than water, and the discs 26 therefore help to counteract any tendency of the dispenser to float in water in which it is placed. The sachet is formed from two flexible generally circular sheets 28 that are joined at their margins by a welded seam 30. Each sheet is formed with a radially outwardly projecting portion that, when welded to the corresponding portion of the other moulding, forms a neck 32 of the sachet. The welding operation that forms the sachet also bonds an end of the liquid inlet tube 20 into the neck 32 of the sachet so as to form a seal between the liquid intet tube 20 and the sachet.

The rigid discs 26 are bonded to the external surface of each sheet 28. During manufacture of the dispenser the sachet is filled with the fragranced surfactant solution through the liquid inlet tube 20 after the welding operation has taken place. Filling the sachet causes the sheets 28 to be forced away from one another. In use, the sachet is subjected to hydrostatic pressure by immersion in water in a lavatory cistern, which pressure causes the sheets 28 to be forced towards one another, so as to expel the fragranced surfactant solution from the sachet through the neck 32 and liquid inlet tube 20. The rigid discs 26 ensure that, when the sachet has been nearly emptied of the fragranced surfactant solution, the remaining solution is prevented from forming pockets in the sachet, but is forced out of the neck 32.

Figure 6:
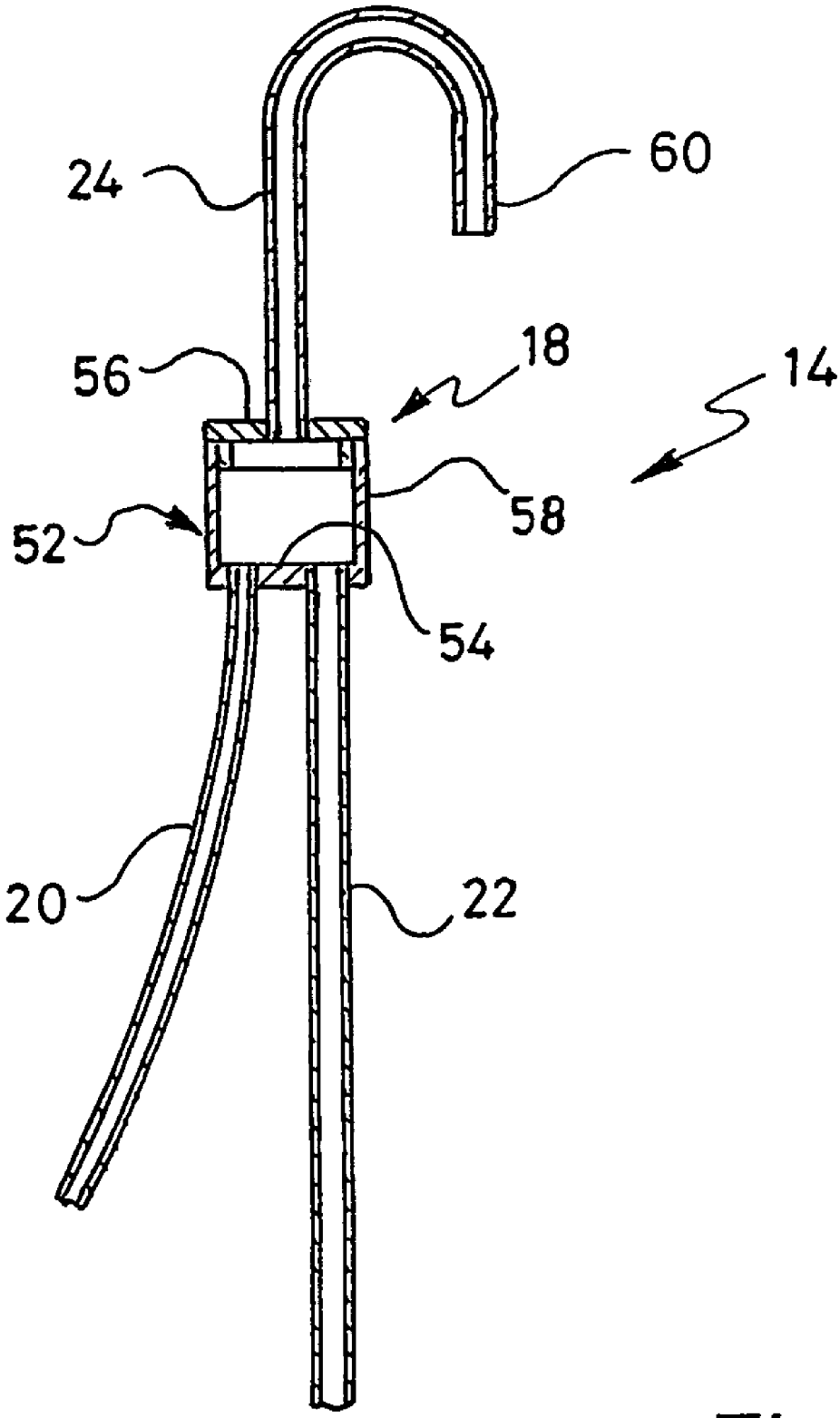
FIG. 6 is a sectional front view of the vent means of the dispensing means of FIG. 1.

Turning to FIG. 6, the vent chamber 18 comprises a cylindrical polypropylene box indicated generally by reference numeral 52. The bottom 54 of the box is provided with two holes into which the liquid inlet tube 20 and liquid outlet tube 22 are sealed. A lid 56 is bonded to the wall 58 of the box, the lid 56 being provided with a hole into which the breather tube 24 is sealed.

The liquid inlet and breather tubes 20 and 24 are plain 1.5 mm diameter polypropylene tubes, although the breather tube 24 is formed with an inverted U-bend so that the free end 60 of the tube points downwards to form an airlock so that water in which the dispenser is immersed is prevented from entering the vent chamber 18.

Figure 7:
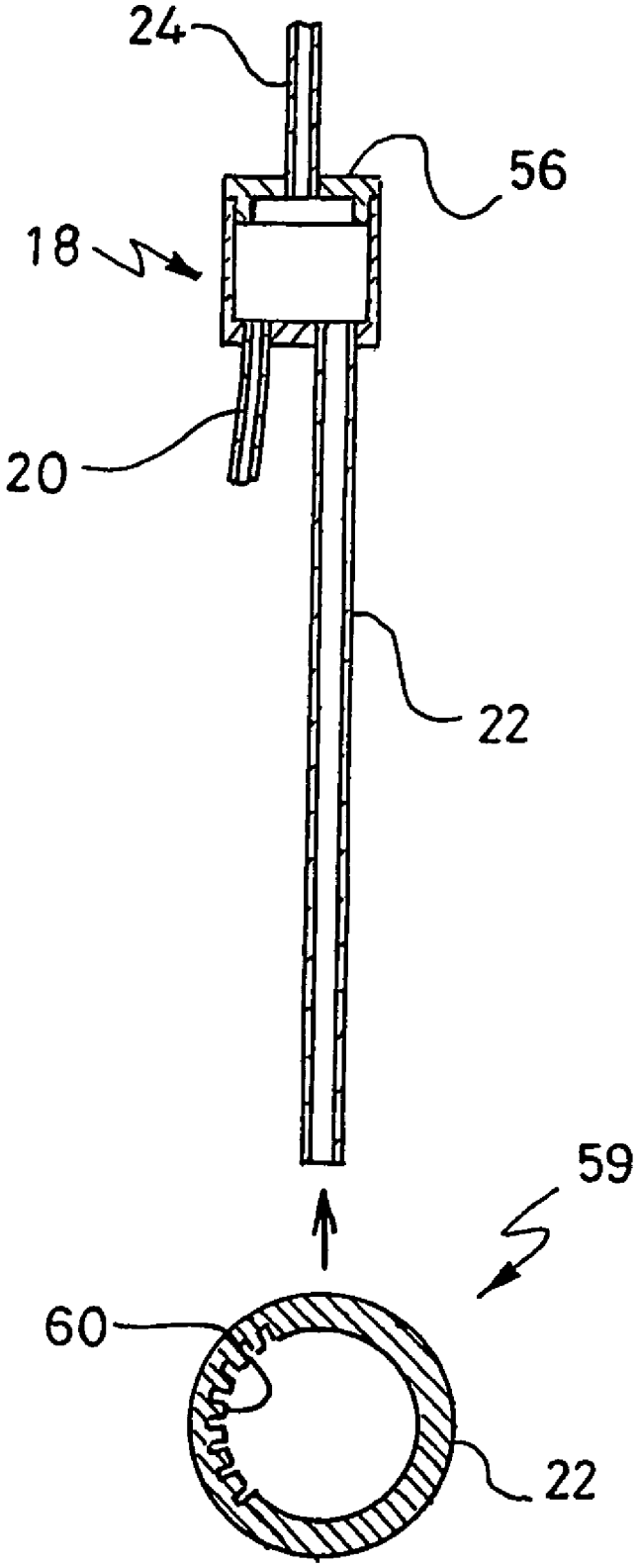
FIG. 7 is a schematic sectional view of the outlet tube of the vent means of FIG. 6.

The liquid outlet tube 22 is a 1.5 mm diameter extruded polypropylene tube that has a large number of very frame longitudinal grooves in its internal surface. Turning briefly to FIG. 7, this is a schematic cross-section, denoted generally by reference numeral 59, of the liquid outlet tube 22, showing some of the very fine longitudinal grooves in the internal surface of the tube, which are denoted generally by reference numeral 60. The grooves 60 have a capillary effect such that when the fragranced surfactant solution is forced into the vent chamber 18 from the liquid inlet tube 20, as soon as the solution reaches the liquid outlet tube 22 it is drawn along the tube by the grooves 60, so as to establish a column of the solution in the liquid outlet tube 22. This has the advantage that the flow of the solution along the liquid outlet tube 22 occurs substantially along the internal surface of the tube, which allows air to be displaced from the tube up the middle of the tube as the column of the solution forms, thus preventing airlocks in the tube that might otherwise occur.

Moreover, because the internal diameter of the vent chamber 18 is much larger than that of the liquid inlet tube 20, once the solution starts to enter the vent chamber the level of the solution in the vent chamber does not start to rise significantly until the column of the solution in the liquid outlet tube has reached the vent chamber, which also helps to prevent airlocks that might otherwise hinder the filling of the liquid outlet tube.

Figure 8:
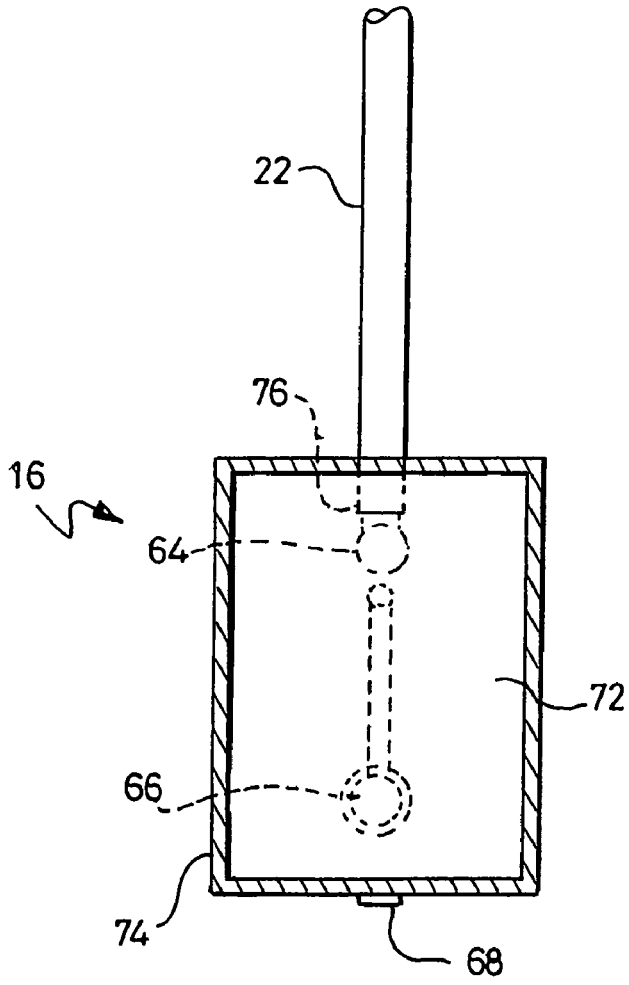
FIGS. 8 and 9 are sectional front and side views of the valve means of the dispensing means of FIG. 1.
Figure 9:
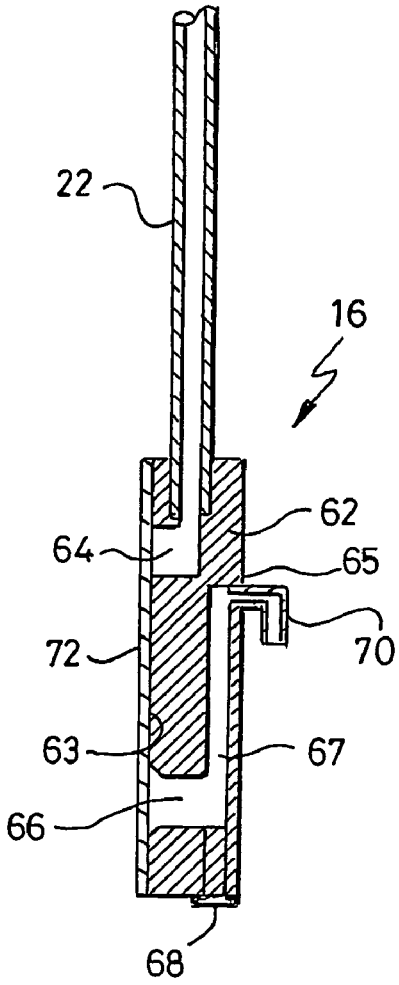

Turning next to FIGS. 8 and 9; the valve 16 comprises a moulded polypropylene valve body 62, in which are formed liquid inlet and outlet channels 64 and 66 respectively. The inlet channel 64 consists of a vertical portion comprising a vertical circular passage that runs from the upper surface of the valve body 62 to its intersection with a horizontal portion comprising a horizontal circular passage that runs from the surface of a first side 63 of the valve body. The liquid outlet tube 22 is sealed into the vertical portion of the inlet channel 64.

The outlet channel 66 also has a vertical portion 67 comprising a vertical circular passage that intersects at its upper end with an upper horizontal portion comprising a horizontal circular passage that runs from the surface of a second side 65 opposite to the first side 63 of the valve body. The vertical portion of the outlet channel 66 intersects at its lower end with a lower horizontal portion comprising a horizontal circular passage that runs from the surface of the first side 63 of the valve body. The vertical portion 67 of the outlet channel 66 is formed by sealing a blanking plug 68 into a lower portion of a vertical circular passage that runs from the lower surface of the valve body to meet the upper horizontal portion of the outlet channel 66, so as to block the vertical circular passage from the lower surface of the valve body to the intersection with the lower horizontal portion of the outlet channel 66.

A downwardly directed nozzle 70 is sealed into the upper horizontal portion of the outlet channel 66 and serves, provided that the fragranced surfactant solution has a density greater than that of water, which will generally be the case, to create an airlock between water in a cistern in which the dispenser is placed and the solution in the outlet channel 66 of the valve.

A flexible metallised polyethylene membrane 72 is welded to the periphery of the first side 63 of the valve body to form a continuous seam 74, so as to seal the openings in the first side 63 of the inlet and outlet channels 64 and 66 from water in a lavatory cistern in which the dispenser is placed. The membrane 72 is stretched slightly before it is welded to the valve body, the resulting tension of the membrane keeping the membrane in engagement with the first side 63 of the valve body so as to prevent flow of the solution from the opening of the inlet channel 64 to the opening of the outlet channel 66.

In FIG. 8 the inlet channel 64, outlet channel 66 and the portion 76 of the liquid outlet tube 22 that is sealed into the inlet channel 64, all of which would normally be hidden by the membrane 72, are shown in broken line.

FIGS. 18 to 22 show the operation of the dispenser 10 that has been suspended in a lavatory cistern (not shown) just above the bottom 112 of the cistern during the course of a filling and flushing cycle.

Figure 18:
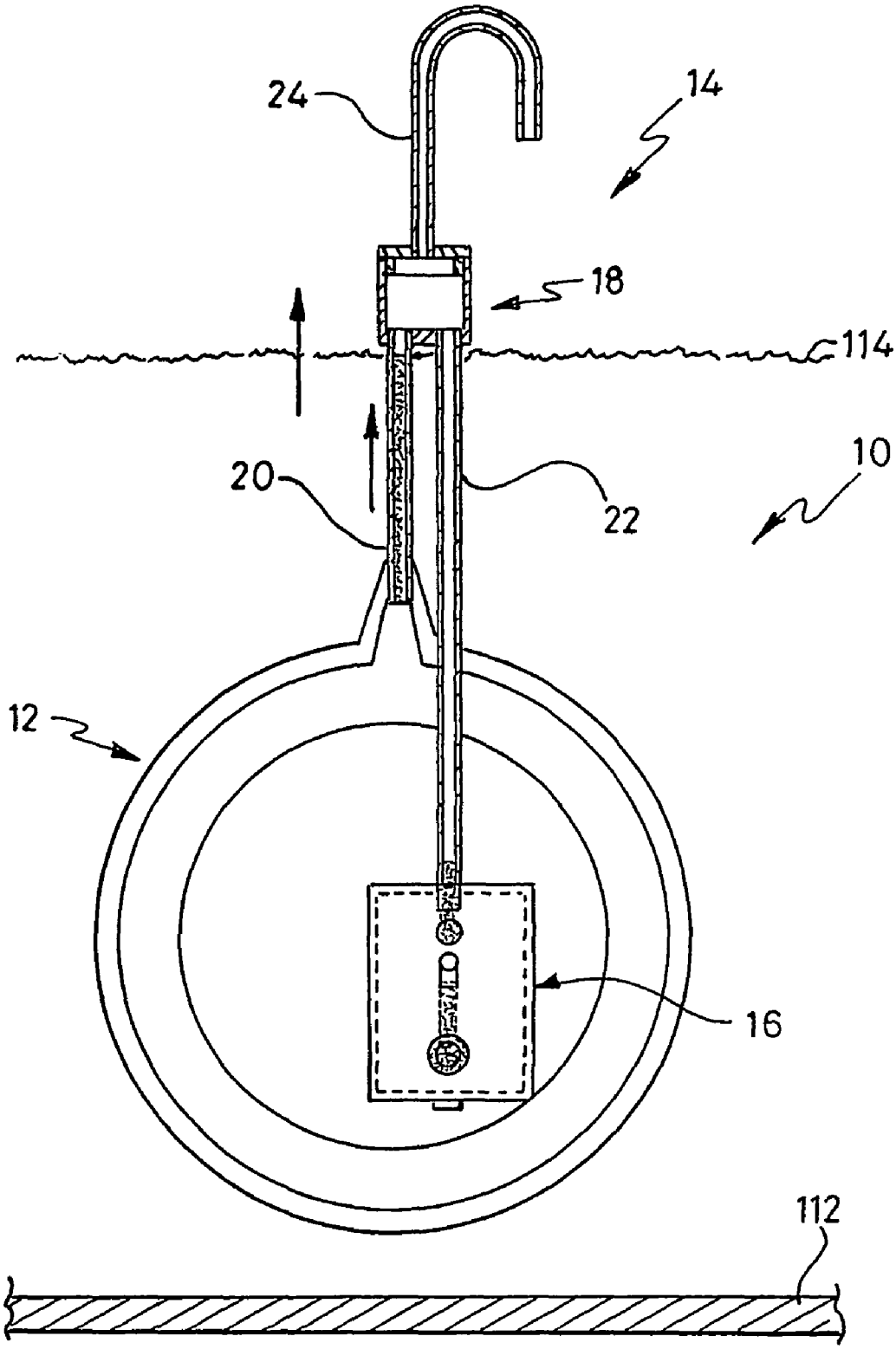
FIGS. 18 to 22 are schematic sectional views of the dispensing means of FIG. 1 placed in a lavatory cistern at various stages as the cistern is filled with, then emptied of, water.

In FIG. 18 the cistern has been flushed and is refilling. As the water level 114 rises relative to the dispenser, the enclosure 12 and valve 16 are subjected to hydrostatic pressure. The hydrostatic pressure acting on the enclosure compresses the enclosure and drives out any air that has been drawn into the enclosure. Air driven out of the enclosure 12 escapes up the liquid inlet tube 20, through the vent chamber 18 and out of the breather tube 24. By the time the water level reaches the top of the enclosure, there is no air remaining in the enclosure, which is completely filled by the fragranced surfactant solution. As the water level rises above the top of the enclosure, the hydrostatic pressure acting on the enclosure forces the solution out of the enclosure into the liquid inlet tube 20.

The level of the solution rises in the liquid inlet tube 20 approximately in step with the water level in the cistern, the differences in the levels being determined by the density of the solution. As can be seen in FIG. 18, the water level and the level of the solution in the liquid inlet tube 20 is just below the vent chamber 18. The inlet and outlet channels of the valve 16 are filled with the solution and a small amount of the solution remains in the bottom of the liquid outlet tube 22.

Figure 19:
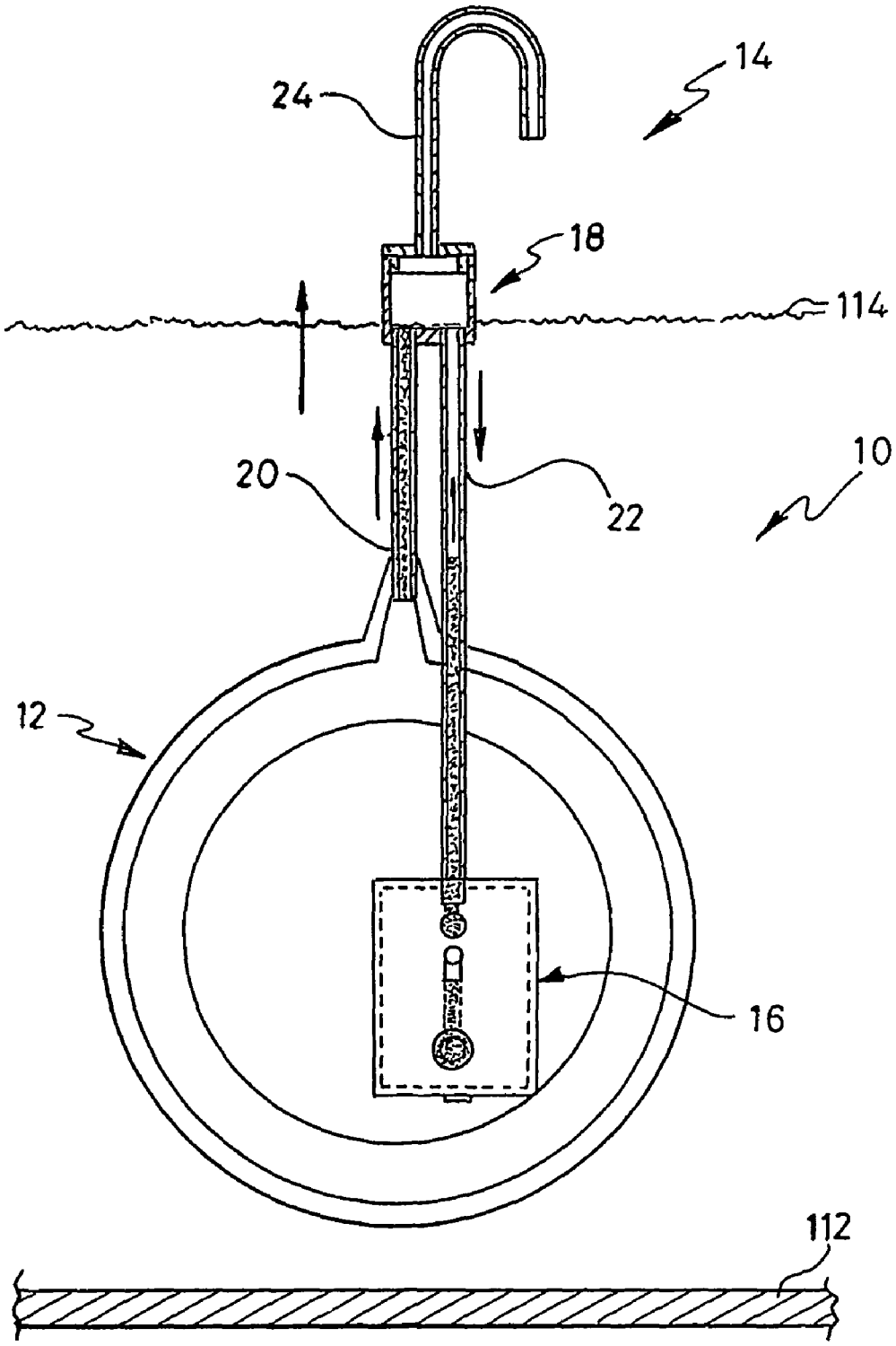

In FIG. 19 the water level and the level of the solution in the liquid inlet tube 20 have reached the vent chamber 18. Any of the solution that enters the vent chamber 18 is drawn down the grooves of the liquid outlet tube 22 and a column of the solution forms very quickly in the liquid outlet tube. The solution is drawn into the liquid outlet tube so quickly that the level of the solution in the vent chamber 18 rises very little until the liquid outlet tube is filled with the solution. Air displaced from the liquid outlet tube by the solution escapes up the centre of the liquid outlet tube as the solution is drawn down the internal surface of the liquid outlet tube, through the vent chamber 18 and out of the breather tube 24.

Figure 20:
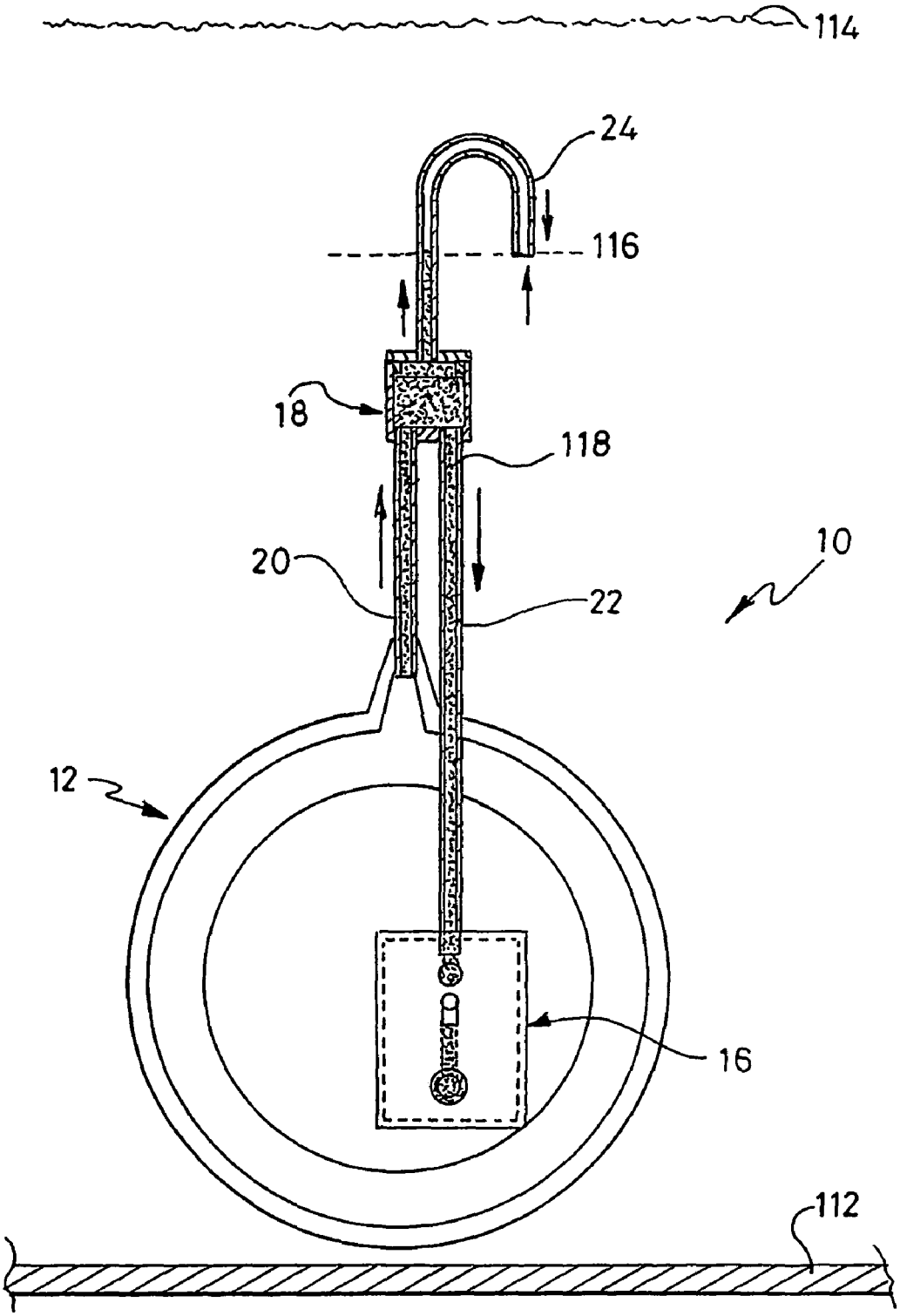

In FIG. 20 the cistern has finished filling and the liquid inlet tube 20, vent chamber 18 and liquid outlet tube 22 are filled with the solution. The level of the solution has risen to a level denoted by reference numeral 116 that is approximately equal to the level of the free end of the breather tube 24. The hydrostatic pressure of the water acting on the membrane of the valve 16 is equal to the hydrostatic pressure of the column 118 of the solution in the liquid outlet tube 22 acting on the membrane, which therefore remains in close engagement with the valve body, preventing a flow of the solution from the inlet channel to the outlet channel.

Figure 21:
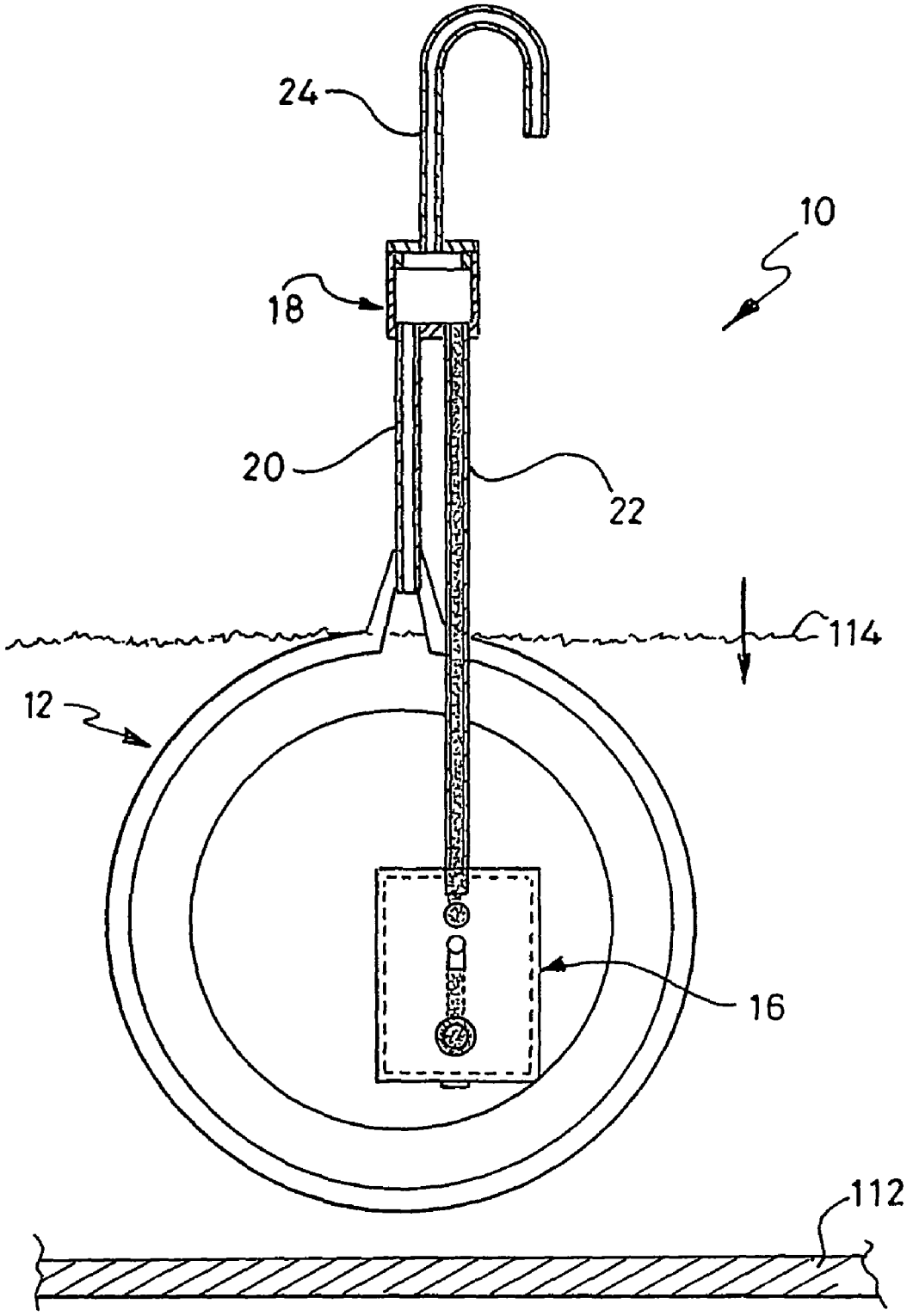

FIG. 21 shows the dispenser 10 during flushing of the cistern. Once the water level in the cistern has fallen to the level of the solution in the breather tube 24, so as to expose the free end of the breather tube to the air, the level of the solution in the breather tube 24, vent chamber 18, and liquid inlet tube 20 falls approximately apace with the water level in the cistern. In FIG. 21 the water level 114 is at the level of the neck of the enclosure 12. It can be seen that the level of the solution in the liquid outlet tube 22 has not fallen, because although the hydrostatic pressure exerted by the column of the solution in the liquid outlet tube on the membrane of the valve is greater than that exerted by the water on the membrane, a minimum difference of pressure is required to deform the membrane sufficiently to enable solution to flow between the membrane and the valve body from the inlet channel to the outlet channel.

Once the minimum required difference of pressure is obtained by means of the falling water level, the hydrostatic pressure exerted by the column of the solution in the liquid outlet tube deforms the membrane of the valve sufficiently for the solution to flow from the inlet channel of the valve to the outlet channel and into the cistern. The flow of the solution from the valve continues until the hydrostatic pressure of the remaining column of the solution in the liquid outlet tube is insufficient to deform the membrane, whereupon the membrane returns to engagement with the valve body, interrupting the flow of the solution from the inlet channel of the valve to the outlet channel.

Figure 22:
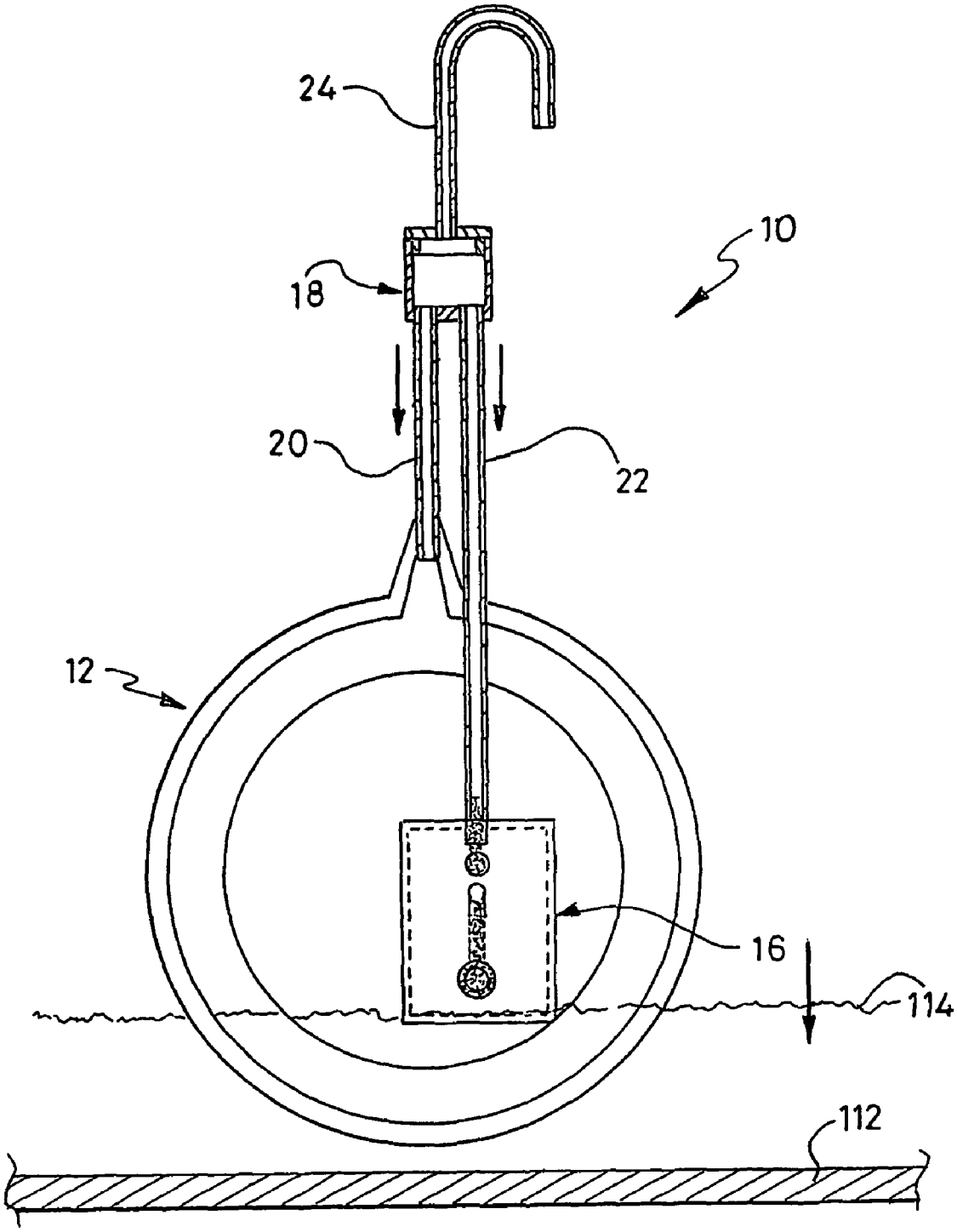

This is the situation shown in FIG. 22, in which the water level 114 in the cistern has fallen to the bottom of the valve. It can be seen from FIG. 22 that, even at the end of a flush cycle, the inlet channel and outlet channel of the valve are filled with the solution.

Figure 23:
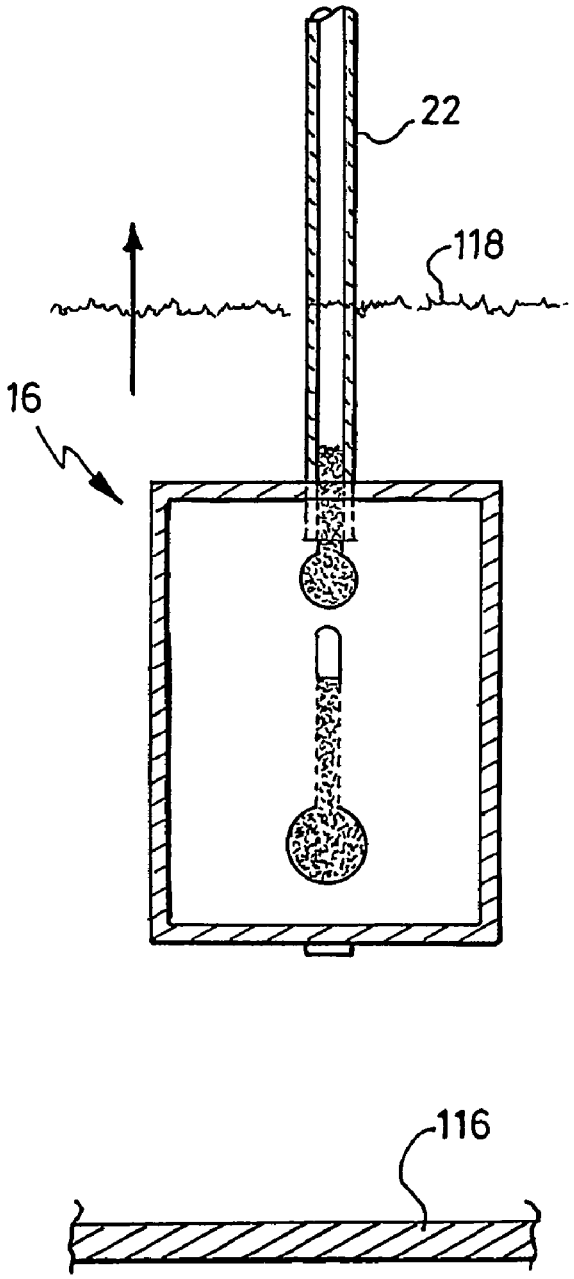
FIGS. 23 to 28 are sectional front and side views of the valve means of the dispensing means of FIG. 1 placed in a lavatory cistern at various stages as the cistern is filled with, then emptied of, water.
Figure 24:
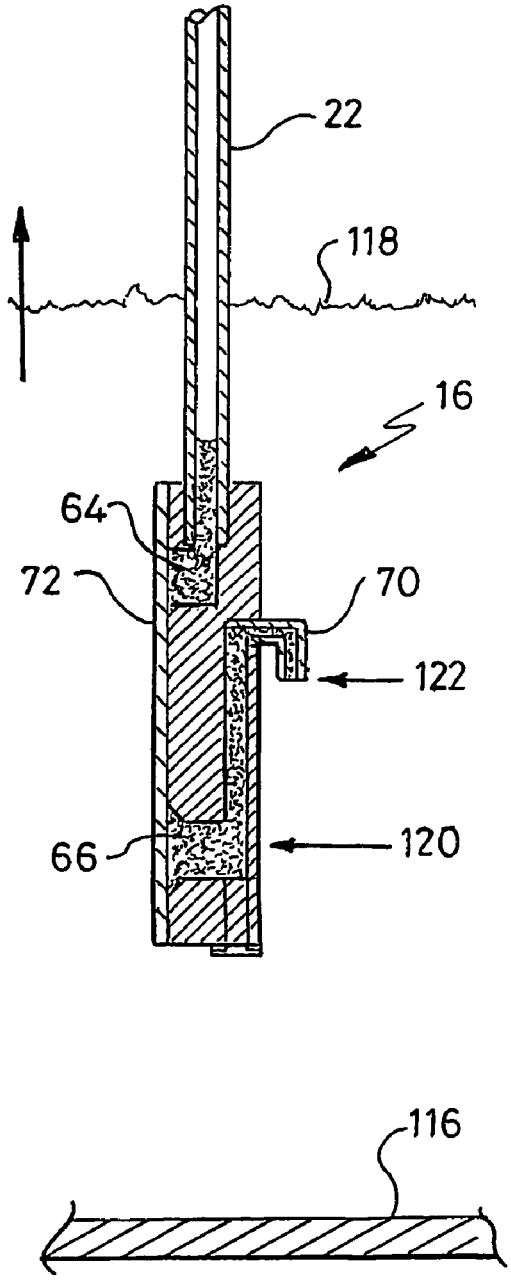

FIGS. 23 to 28 show the operation of the valve 16 during a cycle of filling and flushing of the cistern (not shown), the bottom of which is designated by reference numeral 116. In FIGS. 23 and 24 the cistern is filling after being flushed, the water level 118 not yet having reached the vent chamber and the liquid outlet tube 22 therefore only containing a small quantity of the solution. It is important that the nozzle 70 of the valve is at a higher level than the opening in the first side of the valve body of the liquid outlet channel. This difference in level ensures that, during the filling of the cistern, while the water level is above the valve but below the vent chamber, so that the solution has not yet started to flow into the liquid outlet tube 22, the hydrostatic pressure (denoted in FIG. 24 by reference numeral 120) acting on the membrane due to the water and tending to maintain the membrane in engagement with the valve body is always greater than the hydrostatic pressure (denoted in FIG. 24 by reference numeral 122) acting at the nozzle 70 and tending to force water into the valve, so that water is prevented from entering the valve.

Figure 25:
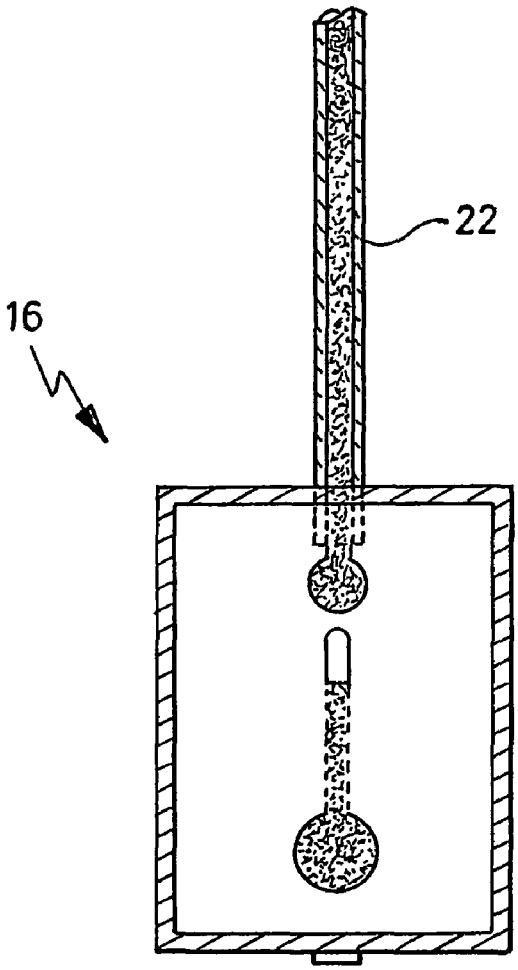
Figure 25:
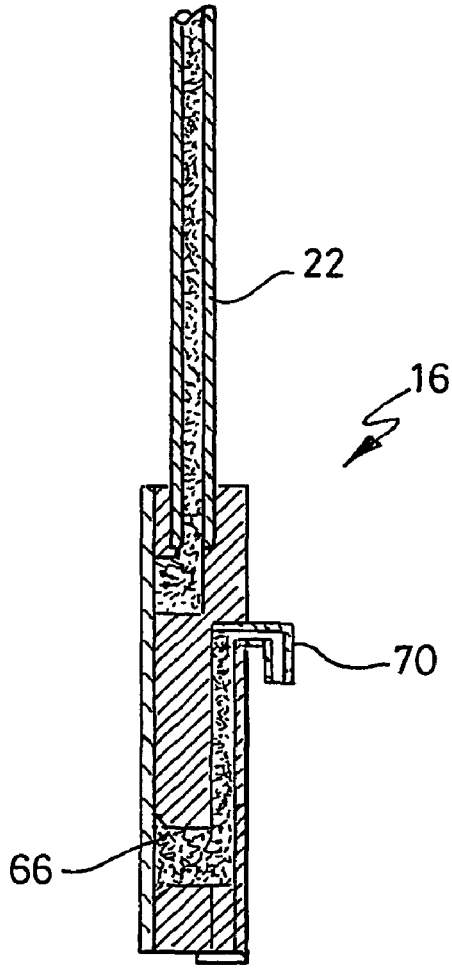
Figure 25:
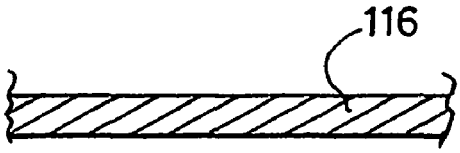
Figure 26:
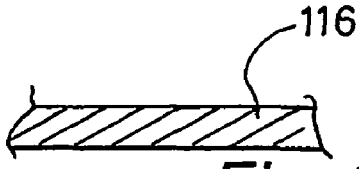

In FIGS. 25 and 26 the valve is submerged and the liquid outlet tube 22 is filled with the solution. As explained in relation to FIGS. 23 and 24, the fact that the level of the solution in the liquid outlet tube 22 may be lower than the water level in the cistern, water is nevertheless prevented from entering the valve by the arrangement of the nozzle 70 above the opening in the valve body of the outlet channel 66.

Figure 27:
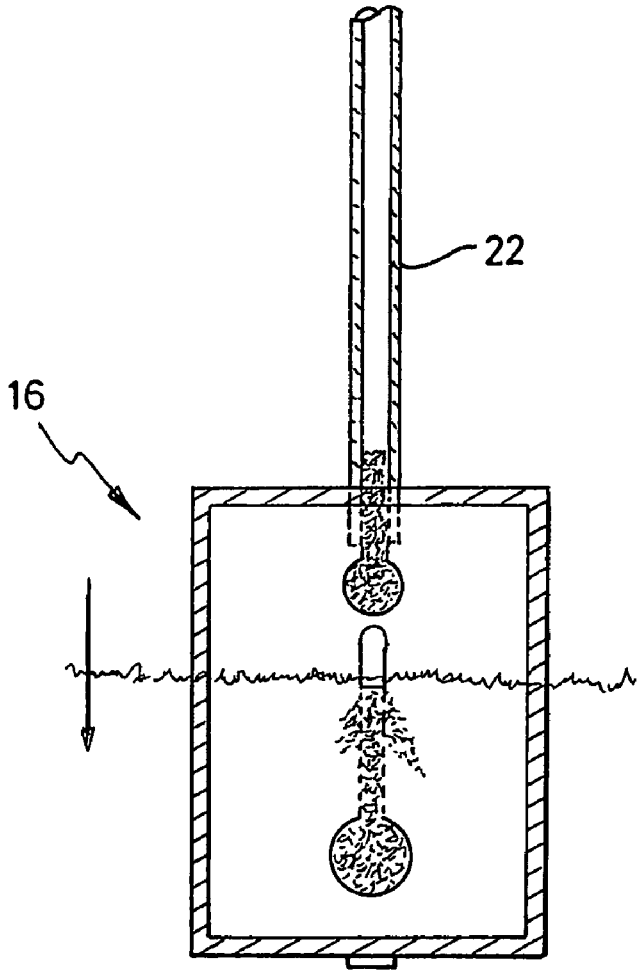
Figure 28:
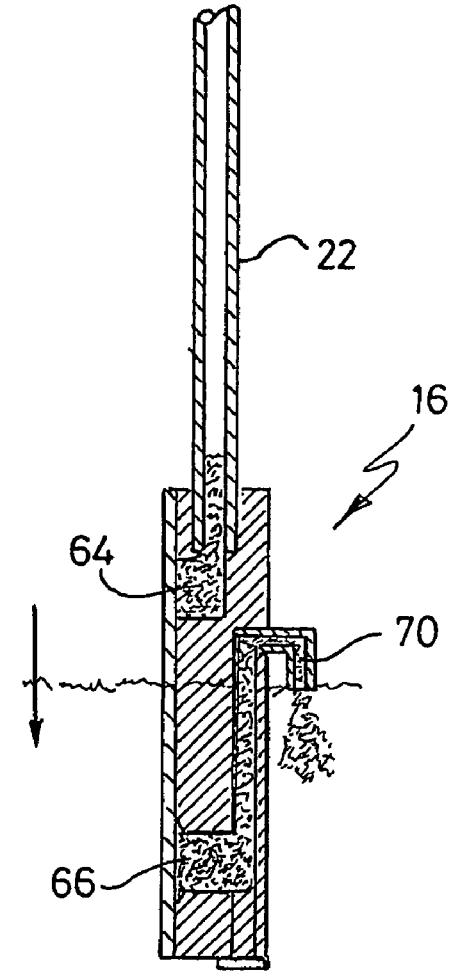

Turning to FIGS. 27 and 28, these show the operation of the valve as the cistern empties during flushing. As explained above, when the water level has fallen sufficiently for the difference between the hydrostatic pressure exerted by the water on the membrane of the valve and the hydrostatic pressure exerted by the column of the solution in the liquid outlet tube 22 to deform the membrane, the solution flows between the membrane and the first side of the valve body from the opening of the inlet channel in the first side of the valve body to the opening of the outlet channel in the first side of the valve body. The flow of the solution from the liquid outlet tube 22 to the nozzle 70 continues until the hydrostatic pressure exerted on the membrane by the remaining column of the solution in the liquid outlet tube 22 is insufficient to maintain the deformation of the membrane, whereafter the membrane resumes its undeformed shape and prevents further flow of the solution through the valve.

Figure 5:
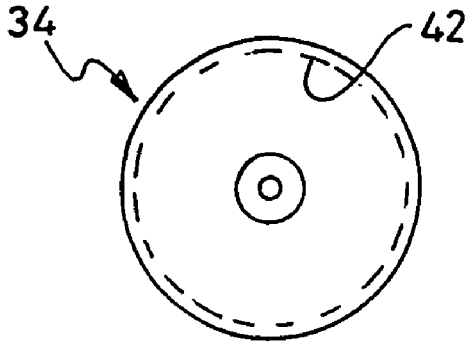
FIGS. 4 and 5 are a sectional side view and a view from above, respectively, of an alternative enclosure to that shown in FIGS. 1 to 3.
Figure 4:
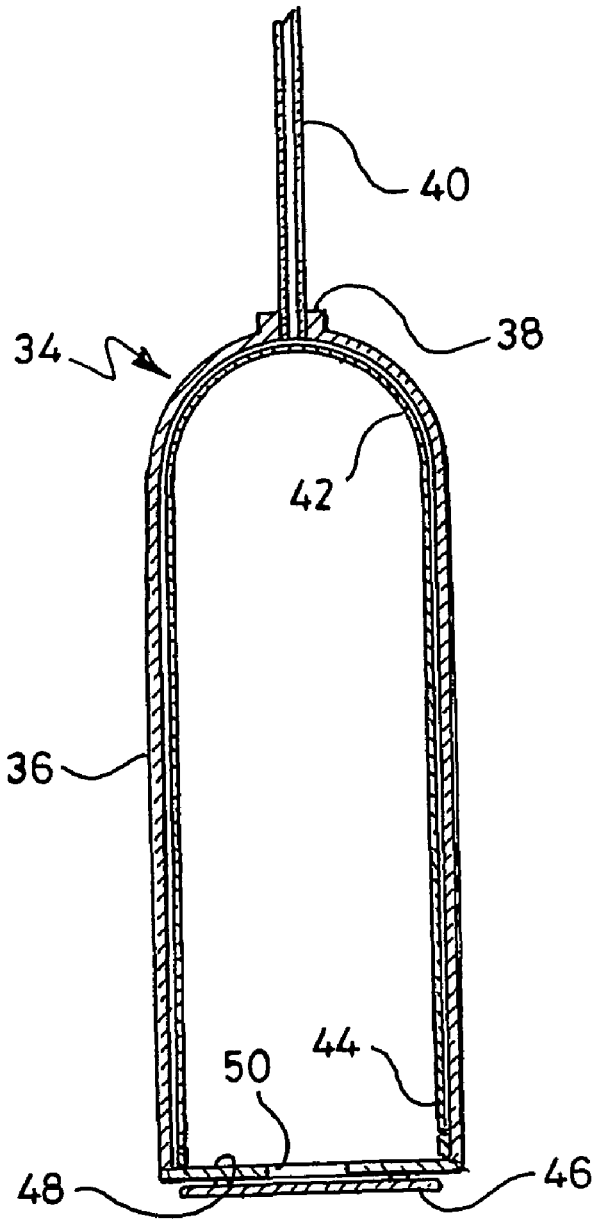

Turning next to FIGS. 4 and 5, these show an alternative enclosure, indicated generally by reference numeral 34. The alternative enclosure comprises a rigid polypropylene cylinder 36 that has a domed upper end 38 into which a liquid inlet tube 40 is bonded. The cylinder 36 is open at its lower end and has a flexible polyethylene sock 42 bonded to the lower end of its internal surface by a continuous welded seam 44. An enclosure is formed between the internal surface of the cylinder 36, the external surface of the sock 42 and the continuous welded seam 44. During manufacture of a dispenser that incorporates the alternative enclosure, the alternative enclosure is filled with a fragranced surfactant solution through the liquid inlet tube 40, which forces the closed end of the sock 42 from the upper end of the cylinder 36 towards the lower end of the cylinder. When the dispenser is subjected to hydrostatic pressure, the closed end of the sock 42 is forced from the lower end of the cylinder 36 towards the upper end of the cylinder, expelling the fragranced surfactant solution from the cylinder through the liquid inlet tube 40.

The lower end of the cylinder 36 is fitted with a circular plug comprising a lower disc 46 and an upper disc 48, the lower and upper discs being attached to one another and separated by a small distance by pegs. The upper disc 48 has a central hole 50 such that when the lower disc rests upon the bottom of a lavatory cistern, water can enter the cylinder 36 between the upper and lower discs and through the hole 50 in the upper disc, so as to subject the sock 42 to hydrostatic pressure and cause the fragranced surfactant solution to be expelled from upper end of the cylinder through the liquid inlet tube 40.

Figure 10:
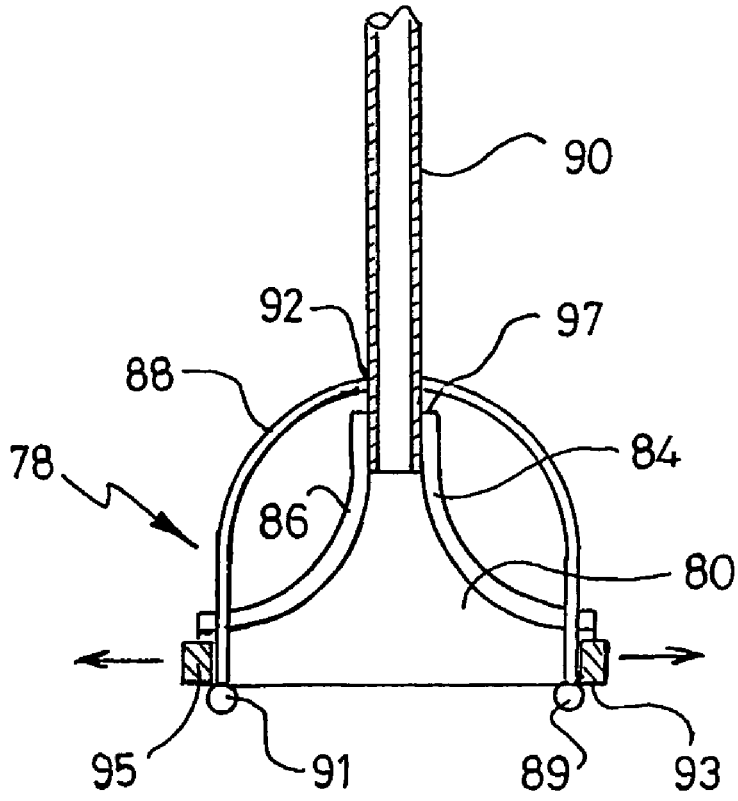
FIGS. 10 and 11 are a sectional side view and a view from below, respectively, of an alternative valve means to that shown in FIGS. 1, 8 and 9.
Figure 11:
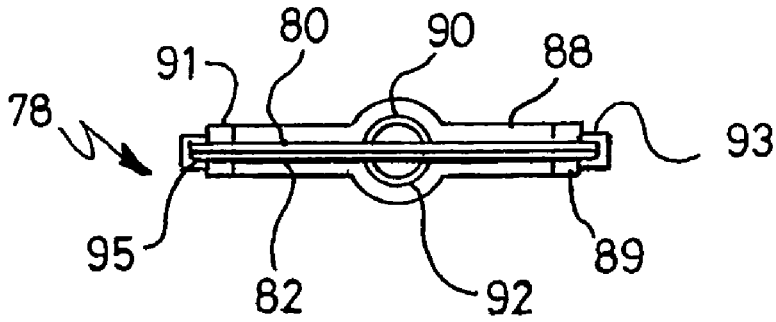

FIGS. 10 and 11 show an alternative valve denoted generally by reference numeral 78. The valve 78 comprises a generally triangular envelope formed from first and second generally triangular polyethylene sheets 80 and 82 that are welded along two of each of their sides so as to form first and second seams 84 and 86, respectively, and a polypropylene spring member 88.

The liquid outlet tube 90 is sealed into the apex 97 of the envelope by the welding process where the first and second seams 84 and 86 meet. The two other apices of the envelope, which border the open side of the envelope, are crimped so as to form lugs 93 and 95. The spring member 88 is bowed and the ends of the spring member are provided with slots that end in toggles 89 and 91. The centre portion of the spring member is formed with a circular hole 92 so that the spring member can be placed over the liquid outlet tube 90 with the liquid outlet tube accommodated in the hole 92.

When the valve is assembled, the liquid outlet tube 90 and envelope are introduced into the spring member so that the tube 90 is accommodated in the hole 92. The ends of the spring member are bent towards one another to enable each end of the open side of the envelope to be introduced into a respective slot at each end of the spring member, so that the lugs are outside the region enclosed by the spring member. The ends of the spring member are released and move away from one another to engage with the lugs 93 and 95. The ends of the spring are prevented from sliding over the lugs by the toggles 89 and 91. The spring member therefore maintains a tension in the open side of the envelope, which tension causes the open edges of the sheets 80 and 82 to be drawn together.

When a column of the solution is present in the liquid outlet tube 90, and the valve 78 is immersed in water, provided that the hydrostatic pressure exerted on the envelope by the water is greater than the hydrostatic pressure exerted by the column of the solution, the hydrostatic pressure exerted by the water will tend to maintain the open edges of the sheets 80 and 82 in contact with one another, thus preventing water from entering the valve and the solution from leaving the valve. When the hydrostatic pressure exerted on the envelope by the water is less than the hydrostatic pressure exerted by the column of the solution, as will happen if a lavatory cistern in which the dispenser has been placed is flushed, the hydrostatic pressure exerted by the column of the solution will tend to part the open edges of the sheets 80 and 82, allowing the solution to leave the valve.

Figure 12:
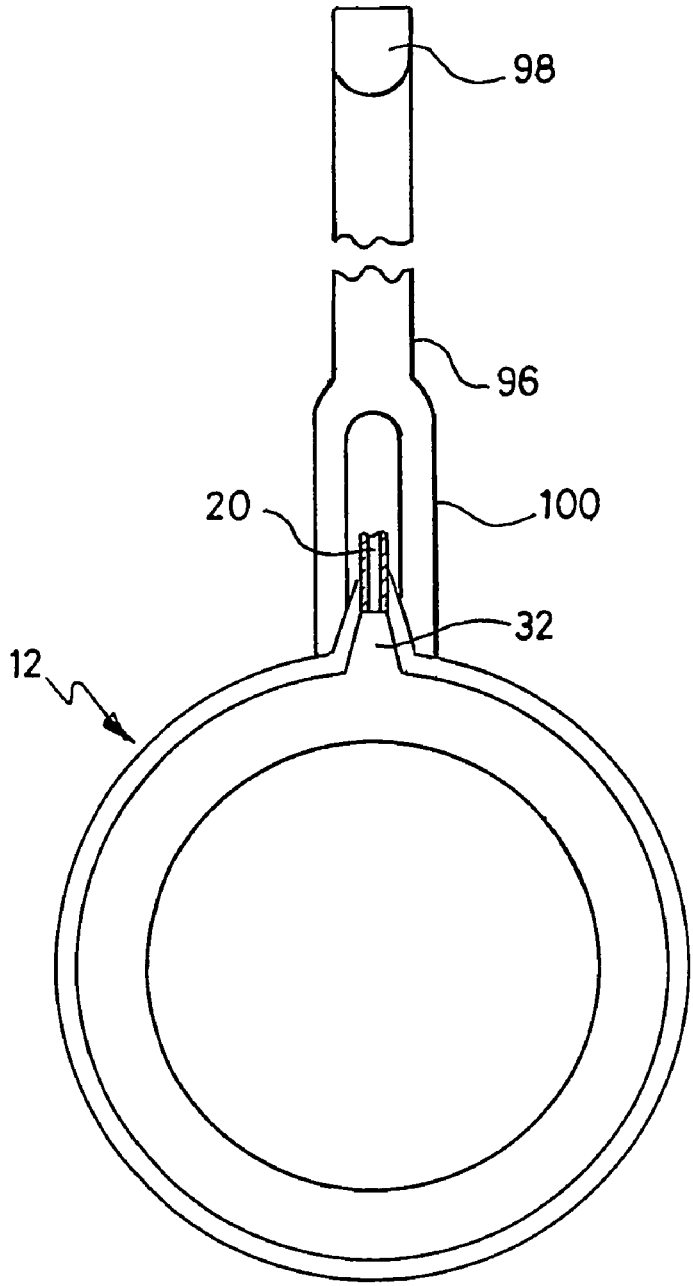
FIGS. 12 and 13 are sectional front and side views, respectively, of the enclosure of FIGS. 1 to 3 modified by the addition of a hook for supporting the dispensing means.
Figure 13:
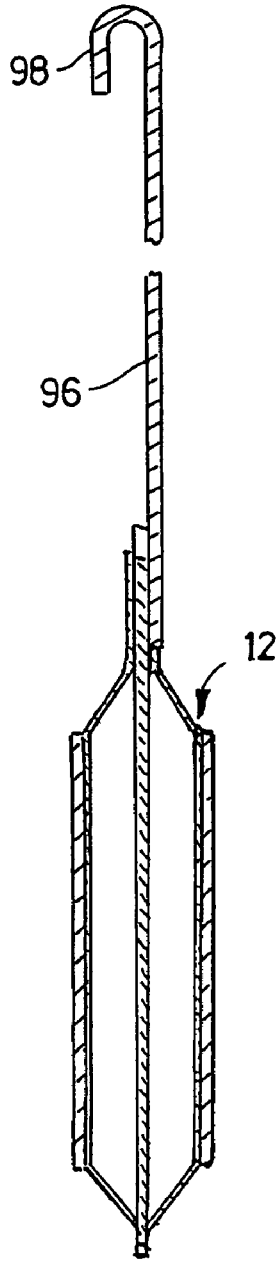

Turning to FIGS. 12 and 13, these show a modification of the enclosure 12, in which a nylon 66 hanger 96 has been bonded to the enclosure adjacent to the neck 32 of the enclosure. Nylon 66 is used for the hanger because it has a greater density than water, and the hanger therefore helps to counteract any tendency of the dispenser to float in water in which it is suspended. The hanger 96 has a curved hook 98 at its upper end that is shaped so as to enable the dispenser to be suspended from a lip of a wall of a lavatory cistern. The hanger is forked at its lower end, one tine being denoted in FIG. 12 by reference numeral 100. The forked lower end of the hanger 96 enables the neck 32 and liquid inlet tube 20 to be accommodated within the hanger.

Although not shown in FIGS. 12 and 13, the hanger 96 is provided with a simple adjustable ratchet mechanism to enable the length of the hanger to be adjusted to suit different sizes of lavatory cisterns. This is desirable because for the most effective use of the dispenser, the dispenser should be arranged to be as close to the bottom of the cistern as possible, so as to mininise the volume of water in the cistern into which the fragranced surfactant solution is dispensed when the lavatory is flushed.

Turning finally to FIGS. 14, 15, 16 and 17, these show an optional modification of the hanger 96 of FIGS. 12 and 13. The tines of the lower end of the hanger are bridged by a web 102 that has first and second bearings 104 and 106 that have circular holes. The hole in the first bearing 104 is denoted in FIG. 14 by reference numeral 107. The first and second bearings carry a shaft 108 that is elliptical in cross-section, the major diameter of the shaft being just less than the diameter of the holes in the bearings 104 and 106. One end of the shaft 108 is provided with a tab 110 to facilitate turning of the shaft by hand.

Figure 14:
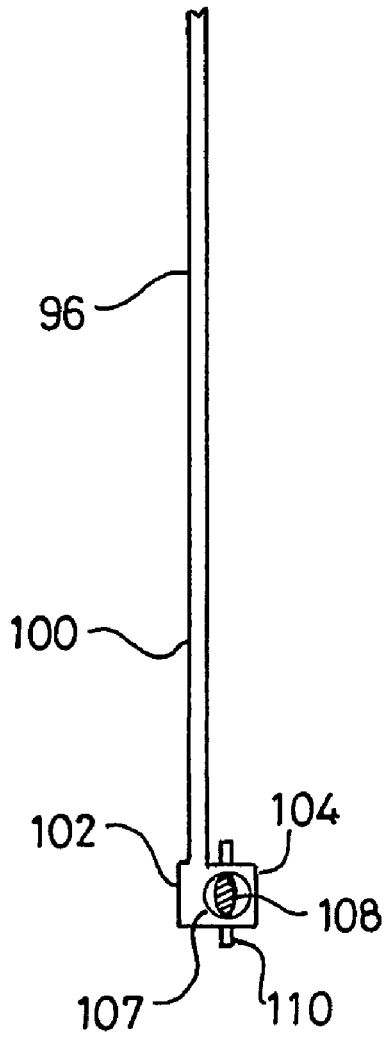
FIGS. 14 and 15 are perspective side and front views, respectively, of the hook of FIGS. 12 and 13 modified by the addition of a tap for controlling a flow of a liquid product from the enclosure of the dispensing means.
Figure 15:
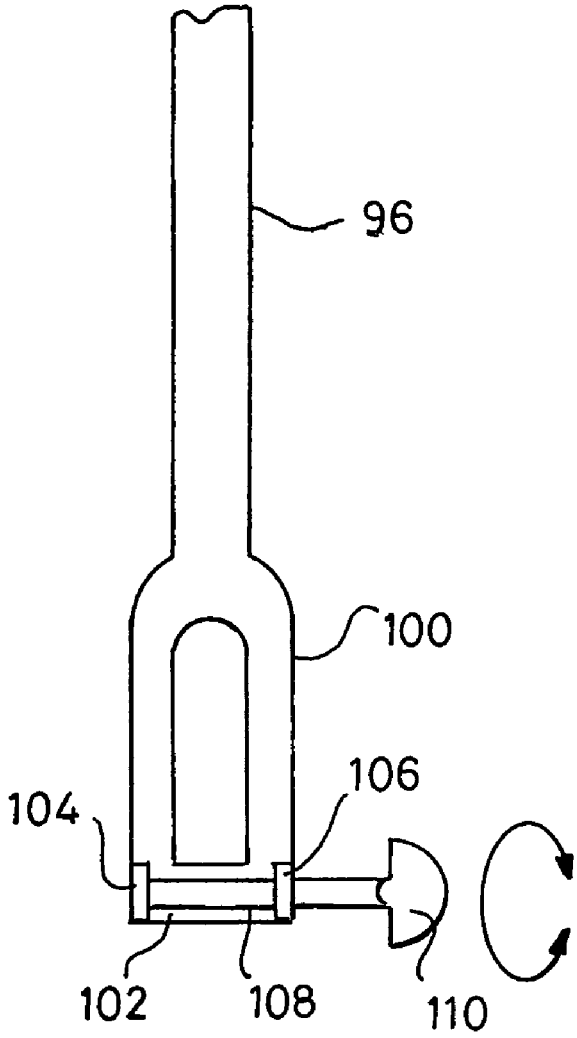
Figure 16:
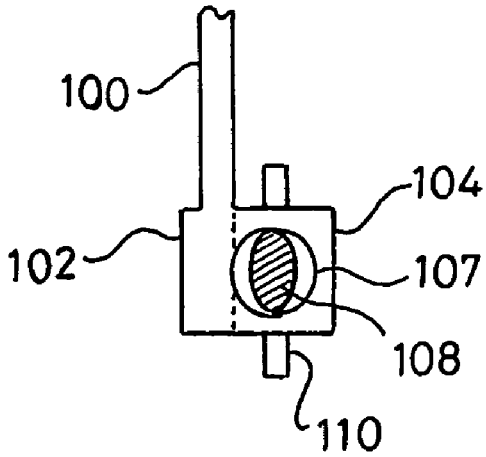
FIG. 16 is a detail of FIG. 14 to illustrate the tap.
Figure 17:
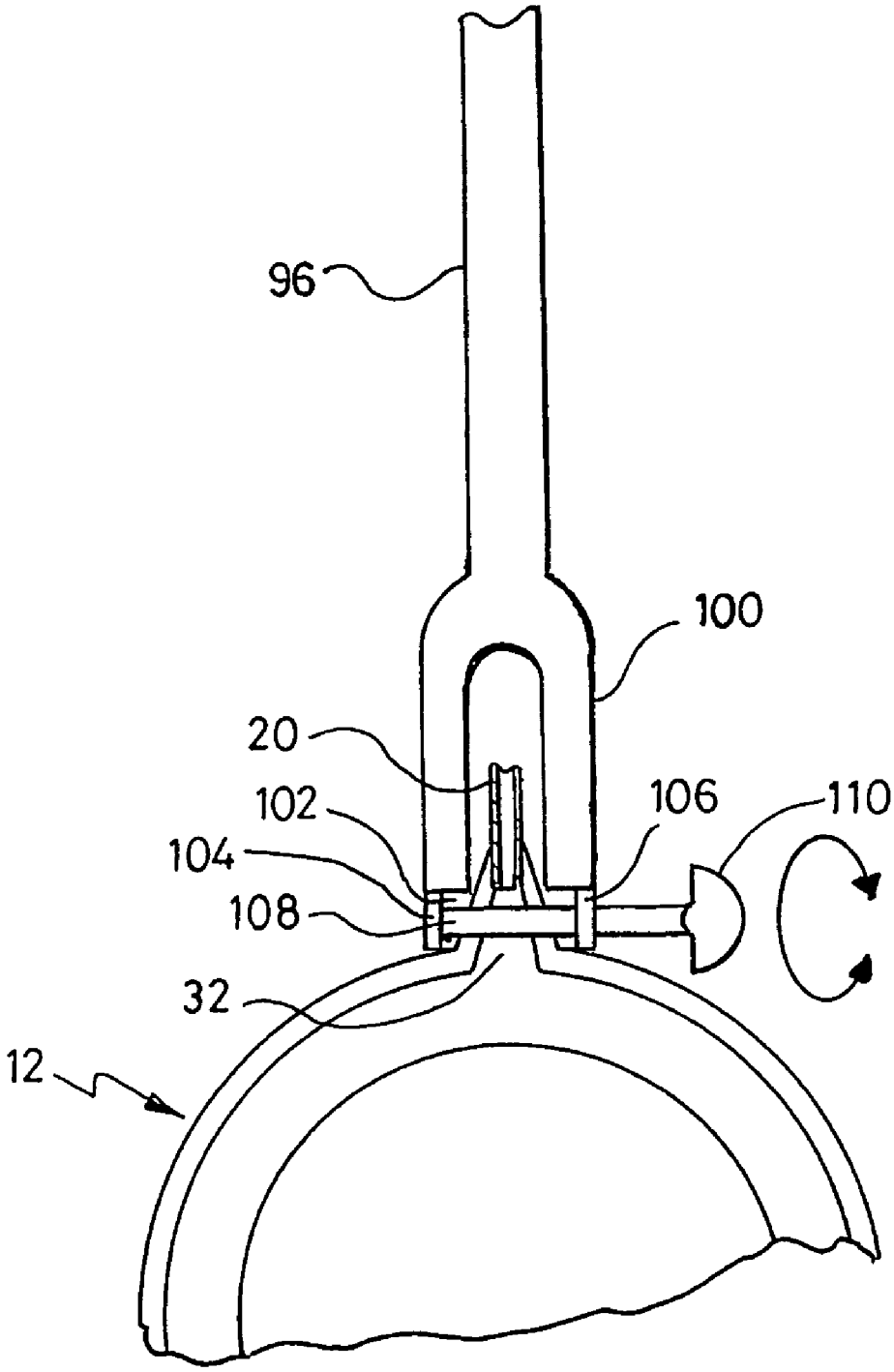
FIG. 17 is a perspective front view of the hook and tap of FIGS. 14 and 15 attached to the enclosure of FIGS. 1 to 3.

As can be seen from FIG. 16, when the shaft is oriented with the major diameter of the shaft parallel to the tine 100, a small gap exists between the web 102, bearings 104 and 106 and shaft 108. When the shaft is oriented with the major diameter of the shaft perpendicular to the tine 100, the gap is closed. To assemble the hanger 96 and enclosure 12, the shaft 108 is removed from the bearings 104 and 106, the neck 32 of the enclosure is laid between the bearings and, with the major diameter of the shaft 108 parallel to the tine 100, the shaft is inserted into the bearings. The neck of the enclosure becomes deeper where the liquid inlet tube 20 is joined to the enclosure, which, in addition to the bonding of the hanger to the enclosure, prevents the enclosure from being detached from the hanger. With the major diameter of the shaft 108 parallel to the tine 100, as shown in FIGS. 14 to 16, the solution can flow from the enclosure into the liquid inlet tube 20. If the shaft is rotated by a quarter turn, however, so that the major diameter of the shaft 108 is perpendicular to the tine 100, the neck of the enclosure is constricted, preventing the solution from leaving the enclosure. This enables the enclosure to be sealed to prevent leakage or deterioration of the solution before use of the dispenser, but allows the enclosure to be unsealed quickly and simply in preparation for use.

It will be apparent that the above description relates only to selected embodiments of the invention, and that the invention encompasses other embodiments as defined by the foregoing statements of the invention.

The invention claimed is:

1. Dispensing device for delivering a dose of a first liquid into a second liquid, the dispensing device comprising an enclosure and valve connected to the enclosure, and being operable such that, when the enclosure contains a first liquid, raising a level of a second liquid relative to the dispensing device so as to subject the enclosure and valve to hydrostatic pressure causes a dose of the first liquid to be displaced from the enclosure to establish a column of the first liquid that acts on the valve and thereby increase the potential energy of the valve, and subsequent lowering of the level of the second liquid relative to the dispensing device so as to reduce the hydrostatic pressure acting on the valve causes the valve to deliver the dose by release of the potential energy, wherein the dispensing device further comprises a vent chamber assembly comprising a vent chamber and first and second tubes, the vent chamber being connected to the enclosure by the first tube and to the valve by the second tube, the dispensing device being operable such that the column of the first liquid is established in the second tube, the vent chamber assembly being operable to vent displaced air from the dispensing device as the column of the first liquid is established, and the second tube being provided with capillary device operable to draw the first liquid along the second tube so as to accelerate the establishment of the column of the first liquid.

2. Dispensing device according to claim 1, wherein the dispensing device is adapted to dispense a plurality of individual doses in succession, one dose being delivered at each lowering of the level of the second liquid as a container in which the dispensing device is placed is repeatedly filled with, and emptied of, the second liquid.

3. Dispensing device according to claim 1, wherein the dispensing device is provided with support means for supporting the dispensing device in a container that is repeatedly filled with, and emptied of, the second liquid.

4. Dispensing device according to claim 3, wherein the support means is a hanger to support the dispensing device from a lip of the container.

5. Dispensing device according to claim 1, wherein the enclosure comprises an otherwise substantially rigid vessel that has a flexible portion, which, when subjected to hydrostatic pressure, is deformable so as to displace a dose of a first liquid contained in the vessel from the vessel.

6. Dispensing device according to claim 1, wherein the enclosure comprises a flexible sachet, which, when subjected to hydrostatic pressure, is deformable so as to displace a dose of a first liquid contained in the sachet from the sachet.

7. Dispensing device according to claim 6, wherein the flexible sachet is provided with at least one rigid member adapted to prevent pockets of the first liquid from forming in the sachet as doses of the first liquid are displaced from the sachet.

8. Dispensing device according to claim 7, wherein the at least one rigid member is formed from a material that has a density greater than that of the second liquid.

9. Dispensing device according to claim 1, wherein the capillary device comprises a wick, lumenous rod and/or rod with a plurality of fine longitudinal grooves formed on its external surface, the wick or rod being operable to draw the first liquid along the second tube.

10. Dispensing device according to claim 1, wherein the capillary device comprises a plurality of fine longitudinal grooves formed on the internal surface of the second tube.

11. Dispensing device according to claim 1, wherein the valve comprises first and second elastic valve members joined so as to form a pocket, and biasing means operable to apply a tensile force to the first and second valve members so as to close the pocket to prevent a flow of the first liquid from the pocket, the valve being operable such that hydrostatic pressure exerted on the exterior of the valve tends to close the pocket.

12. Dispensing device according to claim 1, wherein the valve comprises a valve body and a flexible membrane, the valve body having inlet and outlet channels between which flow of the first liquid is controlled by the flexible membrane, the valve being operable such that hydrostatic pressure exerted on the exterior of the valve tends to cause the flexible membrane to prevent flow of the first liquid between the inlet and outlet channels.

13. Valve for controlling a flow of a first liquid, the valve being adapted for attachment to an inlet tube and comprising a valve body and a flexible membrane, the valve being operable such that, when attached to an inlet tube containing a column of a first liquid and immersed in a second liquid so as to subject the valve to hydrostatic pressure, the hydrostatic pressure causes the flexible membrane to seal the valve body so as to prevent a flow of the first liquid through the valve body, and when a level of the second liquid is lowered relative to the valve so as to reduce the hydrostatic pressure, the flexible membrane unseals the valve body so as to allow a flow of the first liquid through the valve body, wherein the valve body is formed with an inlet channel and an outlet channel, the flexible membrane being operable, when subjected to hydrostatic pressure due to immersion of the valve in the second liquid, to prevent flow of the first liquid from the inlet channel to the outlet channel, and wherein the valve body is so configured that, in use, a first end of the outlet channel through which the first liquid enters the outlet channel is lower than a second end of the outlet channel through which the first liquid exits the outlet channel, such that when the valve is subjected to hydrostatic pressure, the hydrostatic pressure acting at the first end of the outlet channel is greater than that acting at the second end of the outlet channel.

* * * * *